US005448872A

United States Patent [19]

Thompson et al.

[11] Patent Number: 5,448,872

[45] Date of Patent: Sep. 12, 1995

[54] PAN TYPE METAL DOOR

[75] Inventors: James R. Thompson, Lebanon; Robert R. Jackson, Sylvania, both of Ohio

[73] Assignee: MascoTech, Inc., Taylor, Mich.

[21] Appl. No.: 113,077

[22] Filed: Aug. 30, 1993

[51] Int. Cl.[6] ..... E04C 2/34

[52] U.S. Cl. ..... 52/784.13; 52/309.9; 52/792.11

[58] Field of Search ..... 52/802, 803, 804, 805, 52/809, 810, 309.14, 309.8, 309.9

[56] References Cited

U.S. PATENT DOCUMENTS

| | | | |
|---|---|---|---|
| 537,337 | 4/1895 | Bobb . | |
| 993,483 | 5/1911 | Wege . | |
| 1,015,212 | 1/1912 | Schaffert . | |
| 1,848,715 | 3/1932 | Hart et al. . | |
| 2,278,331 | 3/1942 | Meyercord | 52/802 |
| 2,664,182 | 12/1953 | Williams et al. . | |
| 3,333,385 | 8/1967 | King . | |
| 3,413,762 | 12/1968 | Baude . | |
| 3,455,078 | 7/1969 | Brown et al. . | |
| 3,512,305 | 5/1970 | Multer . | |
| 3,633,312 | 1/1972 | Yeager et al. . | |
| 3,786,613 | 1/1974 | Shepheard . | |
| 4,327,535 | 5/1982 | Governale . | |
| 4,438,597 | 3/1984 | Maggart . | |
| 4,589,240 | 5/1986 | Kendall et al. . | |
| 4,819,383 | 4/1989 | McKann et al. . | |
| 4,922,674 | 5/1990 | Thorn | 52/805 |

OTHER PUBLICATIONS

Technical Data Sheet, "Engineering Details For K-18 1¾ "6'-8", 7'-0", 7'-2" & 8'-0" Height Full Flush Doors", The Steelcraft Manufacturing Co., Cincinnati, Ohio, No. 33, Revised Mar. 1963.

*Primary Examiner*—Carl D. Friedman
*Assistant Examiner*—Laura A. Saladino
*Attorney, Agent, or Firm*—Steven J. Rosen

[57] ABSTRACT

A panel assembly that may be used in doors, particularly hollow metal doors, and other types of panels such as interior and exterior walls, room partitions, and the like. The panel assembly exemplified by a hollow or filled metal door is constructed from a deep pan and a shallow pan made from unitary pieces of sheet metal sheet and each pan includes top, bottom, and two opposing side flanges extending from rectangular face members. The flanges of the deep pan are substantially perpendicular to its rectangular face member and higher than those of the shallow pan. Side flanges of one of the pans have first latch members formed along free side edges of their side flanges remote from their respective face member and side flanges of the other pan have second mating latch members formed along free side edges of their side flanges remote from their respective face members. The top and bottom flanges have doubly bent edges that are formed along free side edges of their top and bottom flanges remote from their respective face members. The free side edges of the top and bottom flanges are doubly bent so as to be in overlapping abutting relationship or shiplapped with corresponding ones of the front and rear pans. The first latch member of each pan is secured to the second latch member of the other pan such that the pans are secured and form the panel.

14 Claims, 3 Drawing Sheets

PAN TYPE METAL DOOR

BACKGROUND OF THE INVENTION

1. Field of the Invention

This invention relates to metal doors and particularly to a two piece door construction having two pans that are latched together to form the shell of the door with a core inside.

2. Description of Related Art

Steel doors are typically formed with a metal shell usually having a core inside which may be made of wood or a dense foam such as polyurethane. The steel door shell is typically formed of front and panel members with edge parts or channels therebetween to give the door strength and durability during use and stability during the assembly process. The face plates or panel members of the door have been typically secured by fasteners, such as rivets or screws, or by spot welds. Metal doors have been formed by a pair of telescoping parts locked together by the snap action of latches, avoiding the use of bolts, rivets and welding.

Typical examples of these prior art metal doors are disclosed in U.S. Pat. No. 1,848,715 to Hart and U.S. Pat. and U.S. Pat. No. 4,589,240 to Kendall. However, these constructions have side edges of the door which are interrupted by the latches such that a sufficiently large continuous, smooth metal surface is not provided for the dead bolt and latch preparations or for the hinges. Further, an effective mechanism for properly aligning the panels and maintaining them in an aligned position is not provided.

U.S. Pat. No. 4,896,458, entitled "Door System With Interlocking Panels" to McKann, discloses a door formed by latch and hinge panels which can be attached without fasteners or welding. Each of the panels is formed of a unitary piece of sheet metal and includes a rectangular face member, a side flange extending substantially perpendicularly from the face member along one of its side edges, a first latch formed along a free lateral edge of the side flange remote from the face member, a second latch formed along the opposite side edge of the face member and end flanges extending substantially perpendicularly from the face member along the end edges. The first latch of each panel is secured to the second latch of the other panel such that the panels are secured and form the door, with latches being located at diametrically opposite corners of the door. The McKann patent provides upper and lower end flanges on front and back panels which abut each other and have retaining means comprising projections on one flange of each of the mating flange sets and corresponding mating openings on the other. Tabs are folded against and overlie inner portions of the end flanges to ensure proper alignment of the two panels. The problem with this design is that there is a lack of torsional rigidity because the flanges are not well secured. The need for tabs to prevent lateral shifting of the panels to help hold the door edges formed by side flanges square with the door faces indicates the insufficiency of this design. The alternative retaining means stakes each tab and further indicates the problem of lateral shifting of the panels. But neither design takes into account the twisting of the panels between the upper set and lower set of flanges.

Torsional rigidity with respect to a central axis normal to the front and back of the rectangular door assembly is a common problem of the snap together latching door designs. The problem is particularly acute during the manufacturing and fabrication of the door during which the latched panels are moved from location to location and cutouts are made.

SUMMARY OF THE INVENTION

The present invention provides a panel assembly that is applicable for, but not limited to, use in panels such as doors, particularly hollow metal doors, and other types of panels such as interior and exterior walls, room partitions, and the like.

A panel assembly is constructed from a deep pan and a shallow pan made from unitary pieces of sheet metal sheet and each pan includes top, bottom, and two opposing side flanges extending from rectangular face members. The flanges of the deep pan are substantially perpendicular to its rectangular face member and higher than those of the shallow pan. Side flanges of one of the pans have first latch members formed along free side edges of their side flanges remote from their respective face member and side flanges of the other pan have second mating latch members formed along free side edges of their side flanges remote from their respective face members.

The top and bottom flanges have doubly bent edges that are formed along free side edges of their top and bottom flanges remote from their respective face members. The free side edges of the top and bottom flanges are doubly bent so as to be in overlapping abutting relationship or shiplapped with corresponding ones of the front and rear pans.

The first latch member of each pan is secured to the second latch member of the other pan such that the pans are secured and form the panel such as the door with latch members being located at essentially opposite positions along the sides of the door. An insulating core member is located between the panels.

ADVANTAGES

The present invention provides many advantages such as strength, durability, and ease of assembly. The panel and metal door embodiments of the present invention provide enhanced stability and control of the door assembly during the assembly and manufacturing process. More particularly, the present invention provides enhanced torsional rigidity with well secured panel and door edges (right and left sides and top and bottom ends). This prevents side shifting of the pans and helps hold the door edges square with the door faces. This further eliminates the need for additional structural members to prevent twisting of the door and panels from side to side, end to end, and corner to corner.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
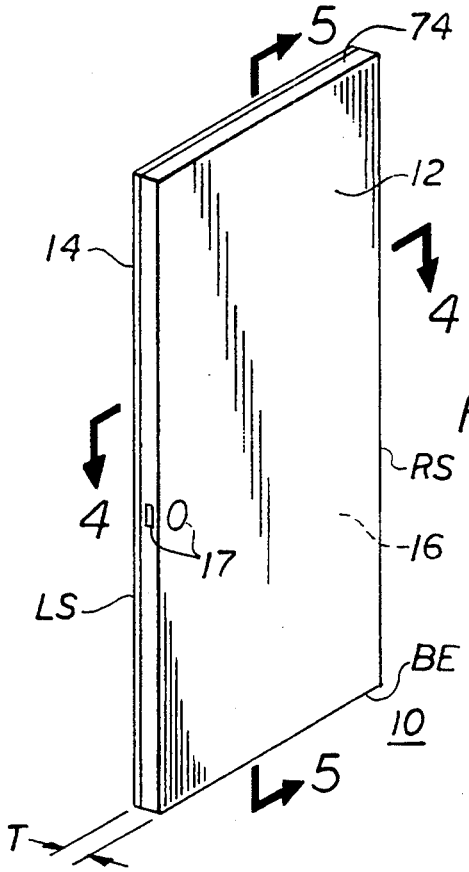
FIG. 1 is a perspective view of a door with a partially exploded view of a door assembly in accordance with one embodiment of the present invention.

Illustrated in FIG. 1 is an exemplary panel in the form of a hollow steel door assembly 10 having a door thickness T and constructed from a deep first pan 12 coupled to a relatively shallow second pan 14 forming an interior 16 therebetween, a top end TE and an opposite bottom end BE, and a left side LS and a right side RS of the door assembly 10. Lock mounting apertures 17 are formed through the left side LS and hinge apertures 18 (shown in FIG. 1A) are formed through the right side RS.

Figure 1B:
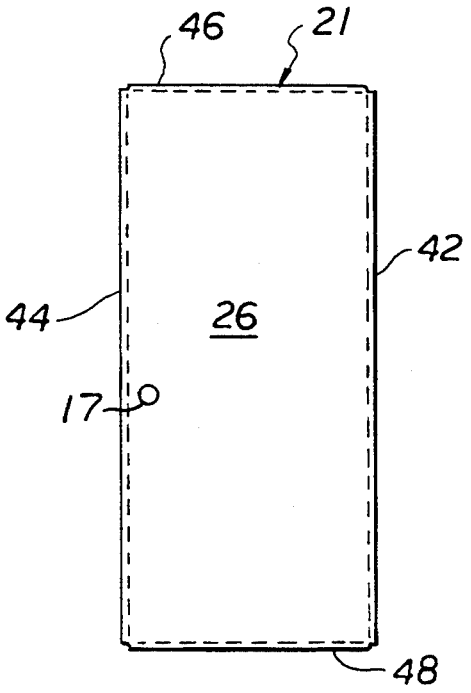
FIG. 1B is flat view of the sheet metal piece used to form the shallow pan.
Figure 1A:
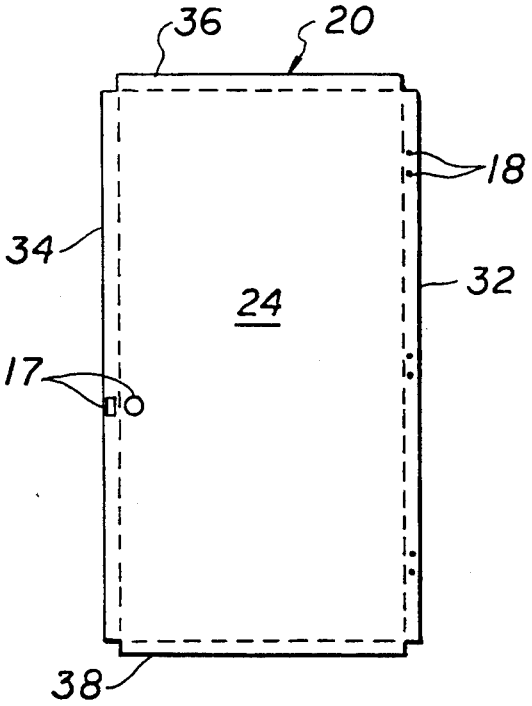
FIG. 1A is flat view of the sheet metal piece used to form the deep pan.

The first and second pans 12 and 14 are formed of first and second unitary pieces 20 and 21 of material, as illustrated in FIGS. 1A and 1B respectively, which for the exemplary door embodiment is metal. The first unitary piece 20 has a rectangular first face member 24 and the second unitary piece 21 has a rectangular second face member 26. The rectangular first face member 24 has opposite first right and left edges 32 and 34 respectively and opposite first top and bottom edges 36 and 38 respectively. The rectangular second face member 26 has opposite second right and left edges 44 and 42 respectively and opposite second top and bottom edges 46 and 48 respectively. The edges are delineated by dashed lines in FIGS. 1A and 1B and extend away from the face members 24 and 26.

Note that the lock mounting apertures 17 and the hinge apertures 18 disposed through the left side LS and the right side RS respectively of the door assembly 10 illustrated in FIG. 1 are more specifically formed in the first left and right edges 34 and 32 respectively of the deep first pan 12 which helps to accomplish two important advantages of the present invention. The apertures on the sides of the door are formed in uninterrupted portions of the door 10 particularly uninterrupted by seams and more particularly for the hinge apertures 18. This strengthens the design of the door by placing the loading associated with the hinges and door handles and locks on the deeper first pan 12 with larger edges and hence the greater strength of the first pan 12 as opposed to the thinner second pan 14.

Figure 2:
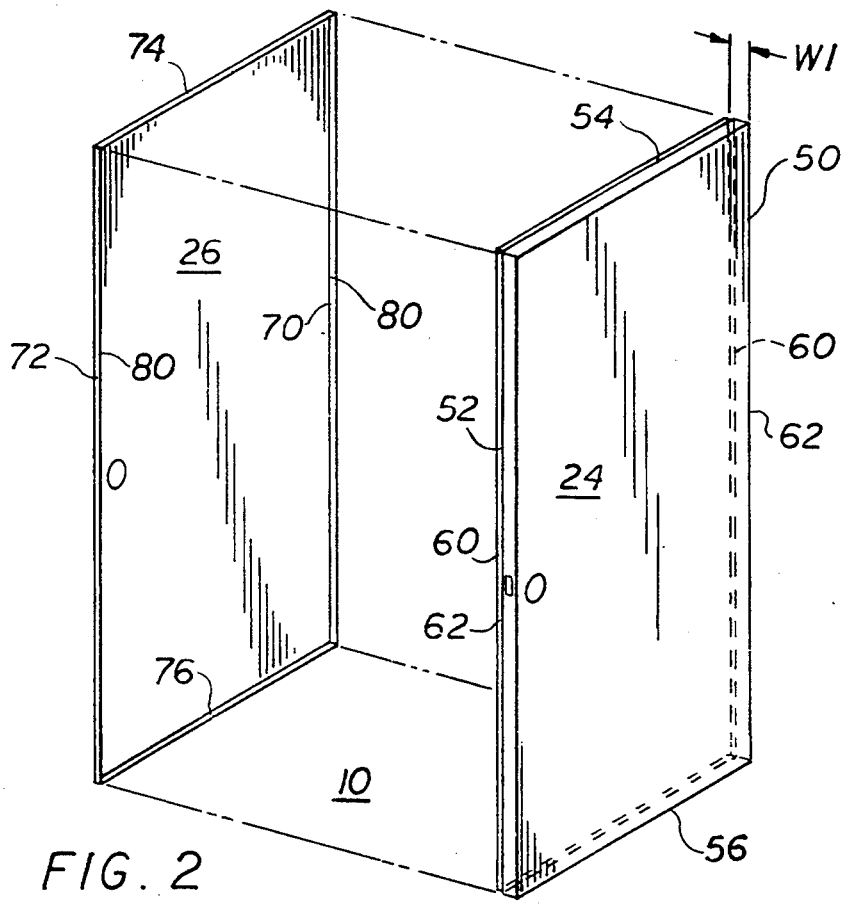
FIG. 2 is an exploded view of the door assembly depicted in FIG. 1 illustrating the pans.

Referring further now to FIGS. 1 and 2, a first right side flange 50 and a first left side flange 52 extend substantially perpendicularly from the first face member 24 and are formed from and along each one of the corresponding first right and left edges 32 and 34 respectively (in FIGS. 1A and 1B). A first top flange 54 and a first bottom flange 56 extend substantially perpendicularly from the first face member 24 and are formed from and along each one of the corresponding first top and bottom edges 36 and 38 respectively (in FIGS. 1A and 1B). The first flanges have a first flange width W1 substantially equal to the door thickness T. A first coupling means 60 is formed along free side edges 62 of said first right side flange 50 and said first left side flange 52 remote from said first face member 24.

A second right side flange 70 and a second left side flange 72 extend from the second face member 26 and are formed from and along each one of the corresponding second right and left edges 42 and 44 respectively (in FIGS. 1A and 1B) to form a second coupling means 80. A second top flange 74 and a second bottom flange 76 extend substantially perpendicularly from the second face member 26 and are formed from and along each one of the corresponding second top and bottom edges 46 and 48 respectively (in FIGS. 1A and 1B).

Figure 4:
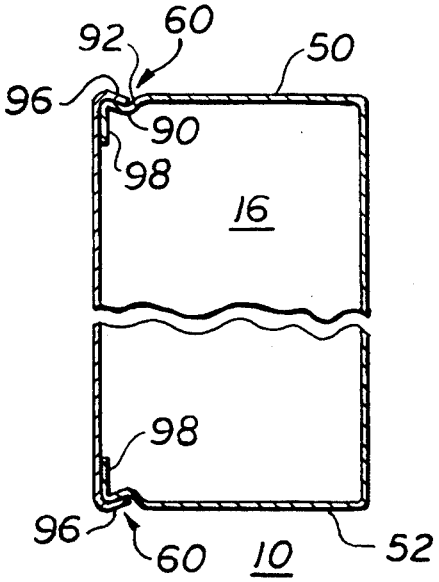
FIG. 4 is a cross-sectional view taken through 4–4 in FIG. 1 illustrating a latching mechanism on the left and right sides of the door in FIG. 1.
Figure 3:
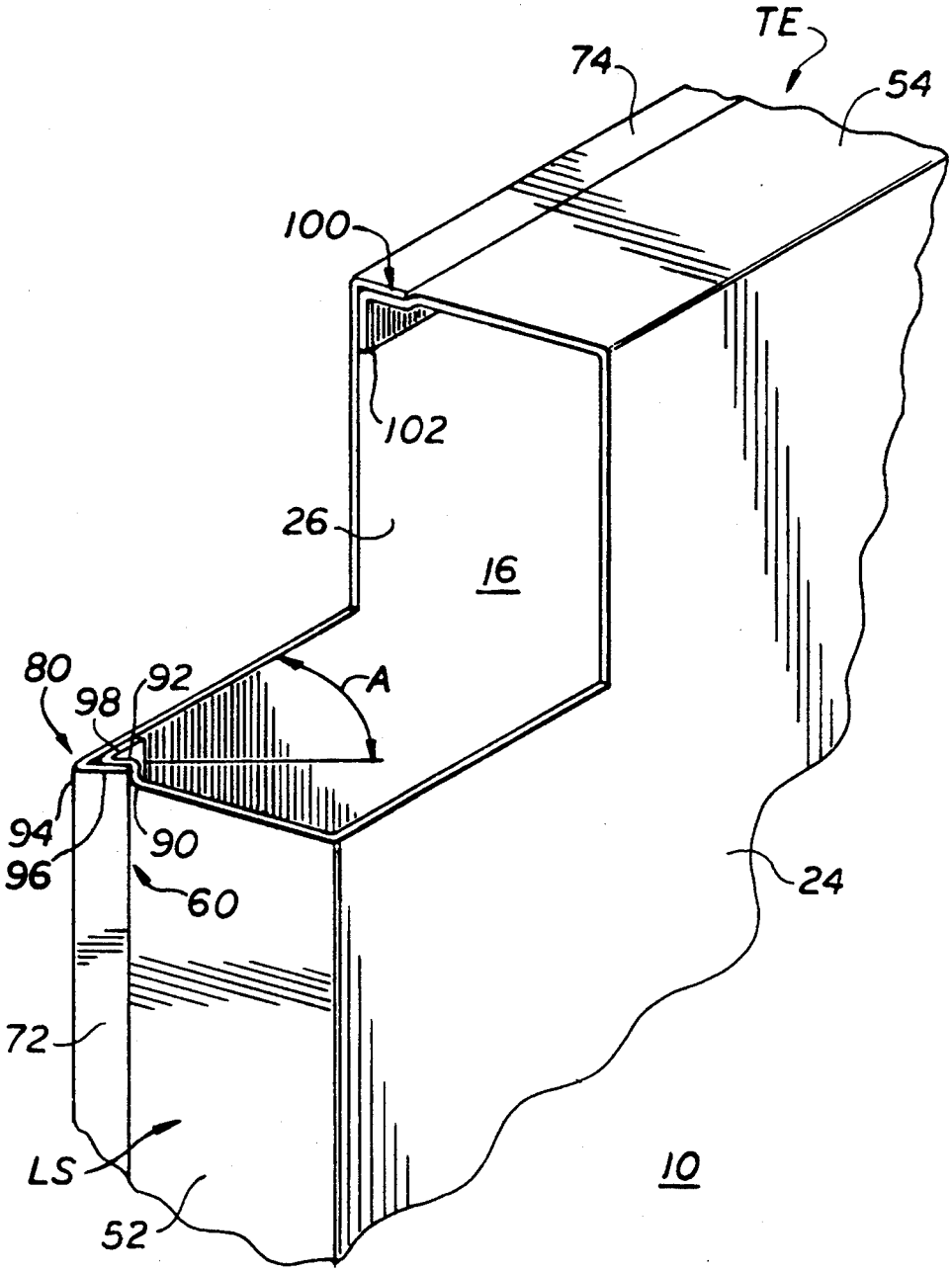
FIG. 3 is a perspective view of a corner of the door in FIG. 1.

Referring now to the exemplary embodiment in FIGS. 3 and 4, the first coupling means 60 is illustrated as a first latch member 90 having an inwardly indented notch 92 and extending substantially over the length of the first right side flange 50 and the first left side flange 52. The second coupling means 80 is illustrated as a second latch member 94 having an inwardly angled latch hook 96 which extends substantially along the length of and essentially is the second left side flange 72 bent at an acute angle A to the second face member 26. The latch hook 96 engages the first latch member 90 within the indented notch 92. The first latch member 90 also includes side legs 98 extending substantially perpendicularly from the first right side flange 50 and the first left side flange 52 and are disposed in tight abutting relationship with the second face member 26. This provides broad surfaces which reduce the pressure along the mating surfaces of the two pans thus allowing strong forces to be employed by the first and second coupling means to hold and secure the two pans together.

Figure 5:
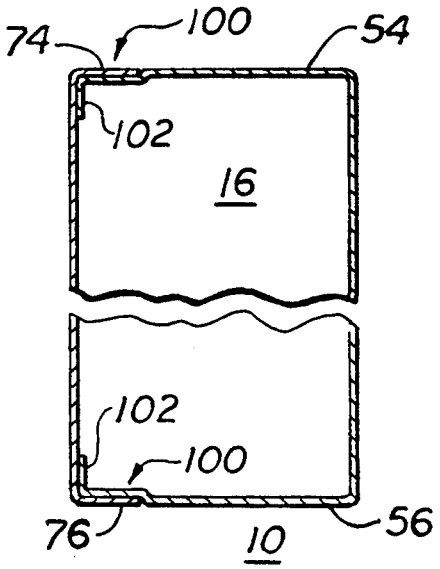
FIG. 5 is cross-sectional view taken through 5—5 in FIG. 1 illustrating of the door in FIG. 1.

Referring now to FIGS. 3 and 5, the second top and bottom flanges 74 and 76 respectively are disposed outwardly of and in tight overlapping engagement with the corresponding first top and bottom flanges 54 and 56 respectively. The corresponding first and second flanges are also shiplapped along their overlapping areas 100. Side legs 102 extend substantially perpendicularly from the first top and bottom flanges 54 and 56 respectively and are disposed in tight abutting relationship with the second face member 26. This produces a clamping force on the first pan 12 by the second pan 14 which secure the pans and form the door 10. This clamping action along the overlapping areas 100 also helps prevent twisting of the pans along the overlapping areas.

The door light assembly invention discussed above illustrates embodiments of the present invention for use in a door but other embodiments of the present invention are contemplated for other types of light installations in other types of partitions such as interior and exterior walls of residential, commercial, and industrial buildings.

While the preferred embodiment of the present invention has been described fully in order to explain its principles, it is understood that various modifications or alterations may be made to the preferred embodiment without departing from the scope of the invention as set forth in the appended claims.

We claim:

1. A panel comprising:

a deep first pan and a relatively shallow second pan as compared to said first pan, said pans secured together forming an interior therebetween, said first and second pans being formed of unitary pieces of material having rectangular first and second face members with first and second opposite right and left side edges and with first and second opposite top and bottom edges respectively, first right and left side flanges and first top and bottom end flanges extending substantially perpendicularly from said first face member along each one of said corresponding first edges, said first flanges having a width substantially equal to a thickness of the panel, a first coupling means formed along free side edges of said first side flanges remote from said first face member, second right and left side flanges extend generally at an acute angle from said second face member and second top and bottom end flanges extending substantially perpendicularly from said second face member along each one of said corresponding second edges, a second coupling means formed from and along said second side flanges, corresponding sets of said first end and second end flanges are disposed in tight overlapping engagement, and said first coupling means of said first pan engaging corresponding said second coupling means of said second pan to secure said pans and form the panel, and said first end flanges are shiplapped with said second end flanges such that outer surfaces of corresponding sets of said first and second end flanges are co-planar.

2. A panel as claimed in claim 1 wherein said first end flanges are disposed inward of said second end flanges and further comprise edge flanges extending substantially perpendicularly from said second end flanges in abutting relationship with said second face member.

3. A panel comprising:

a deep first pan and a relatively shallow second pan as compared to said first pan, said pans secured together forming an interior therebetween, said first and second pans being formed of unitary pieces of material having rectangular first and second face members with first and second opposite right and left side edges and with first and second opposite top and bottom edges respectively, first right and left side flanges and first top and bottom end flanges extending substantially perpendicularly from said first face member along each one of said corresponding first edges, said first flanges having a width substantially equal to a thickness of the panel, a first coupling means formed along free side edges of said first side flanges remote from said first face member, second right and left side flanges extend generally at an acute angle from said second face member and second top and bottom end flanges extending substantially perpendicularly from said second face member along each one of said corresponding second edges, a second coupling means formed from and along said second side flanges, corresponding sets of said first end and second end flanges are disposed in tight overlapping engagement, and said first coupling means of said first pan engaging corresponding said second coupling means of said second pan to secure said pans and form the panel, said first coupling means comprising a first latch member having an inwardly indented notch extending substantially over the length of said free side edges of said first side flanges and side legs extending substantially perpendicularly from said first side flanges in abutting relationship with said second face member, said second coupling means comprising a second latch member having an inwardly angled latch edge extending substantially along the length of said free side edges of said second side flanges and which engages said first coupling means within said indented notch, and said first end flanges are shiplapped with said second end flanges such that outer surfaces of corresponding sets of said first and second end flanges are co-planar.

4. A panel as claimed in claim 3 wherein said first end flanges are disposed inward of said second end flanges and further comprise edge flanges extending substantially perpendicularly from said second end flanges in abutting relationship with said second face member.

5. A panel comprising:

a deep first pan and a relatively shallow second pan as compared to said first pan, said pans secured together forming an interior therebetween, said first and second pans being formed of unitary pieces of material having rectangular first and second face members with first and second opposite right and left side edges and with first and second opposite top and bottom edges respectively, first right and left side flanges and first top and bottom end flanges extending substantially perpendicularly from said first face member along each one of said corresponding first edges, said first flanges having a width substantially equal to a thickness of the panel, a first coupling means formed along free side edges of said first side flanges remote from said first face member, second right and left side flanges extend generally at an acute angle from said second face member and second top and bottom end flanges extending substantially perpendicularly from said second face member along each one of said corresponding second edges, a second coupling means formed from and along said second side flanges, corresponding sets of said first end and second end flanges are disposed in tight overlapping engagement, and said first coupling means of said first pan engaging corresponding said second coupling means of said second pan to secure said pans and form the panel, and the panel is a door and said unitary piece of said first face member has hinge and lock mounting apertures therethrough.

6. A panel as claimed in claim 5 wherein said second flanges having a width substantially equal to a thickness of said second pan.

7. A metal door, comprising:

a deep first pan and a relatively shallow second pan as compared to said first pan and latched together forming an interior therebetween, said first and second pans being formed of unitary pieces of metal having rectangular first and second face members with first and second opposite right and left side edges and with first and second opposite top and bottom edges respectively, first right and left side flanges and first top and bottom end flanges extending substantially perpendicularly from said first face member along each one of said corresponding first edges, said first flanges having a width substantially equal to a thickness of the metal door, a first coupling means formed along free side edges of said first side flanges, second right and left side flanges extending generally at an acute angle and second top and bottom end flanges extending substantially perpendicularly from said second face member along each one of said corresponding second edges, said second flanges having a width substantially equal to a thickness of a second coupling means formed along free side edges of said second side flanges, corresponding sets of said first end and second end flanges are disposed in tight overlapping engagement, and said first coupling means of said first pan engaging corresponding said second coupling means of said second pan to secure said pans and form the door.

8. A metal door as claimed in claim 7 wherein said first end flanges are shiplapped with said second end flanges such that outer surfaces of corresponding sets of said first and second end flanges are co-planar.

9. A metal door as claimed in claim 8 wherein said first end flanges are disposed inward of said second end flanges and further comprise edge flanges extending substantially perpendicularly from said second end flanges in abutting relationship with said second face member.

10. A metal door as claimed in claim 7 wherein said first coupling means comprises a first latch member having an inwardly indented notch extending substantially over the length of said free side edges of said first side flanges and wherein said second coupling means comprises a second latch member having an inwardly angled latch edge extending substantially along the length of said free side edges of said second side flanges and which engages said first coupling means within said indented notch.

11. A metal door as claimed in claim 10 wherein said first latch members further comprise side legs extending substantially perpendicularly from said first side flanges in abutting relationship with said second face member.

12. A metal door as claimed in claim 11 wherein said first end flanges are shiplapped with said second end flanges such that outer surfaces of corresponding sets of said first and second end flanges are co-planar.

13. A metal door as claimed in claim 12 wherein said first end flanges are disposed inward of said second end flanges and further comprise edge flanges extending substantially perpendicularly from said second end flanges in abutting relationship with said second face member.

14. A metal door as claimed in claim 13 wherein said unitary piece of said first face member has hinge and lock mounting apertures therethrough.

* * * * *